US005571243A

United States Patent [19]

Arnold et al.

[11] Patent Number: 5,571,243

[45] Date of Patent: Nov. 5, 1996

[54] PUMP DEVICE FOR SUPPLYING FUEL FROM A TANK TO AN INTERNAL COMBUSTION ENGINE

[75] Inventors: Bernhard Arnold, Roden-Ansbach; Egon Eisenbacher, Karlstadt; Franz Pawellek, Hafenlohr, all of Germany

[73] Assignee: Elasis Sistema Ricerca Fiat Nel Mezzogiorno Societa Consortile Per Azioni, Pomigliano D'Arco, Italy

[21] Appl. No.: 371,017

[22] Filed: Jan. 11, 1995

[30] Foreign Application Priority Data

Jan. 15, 1994 [DE] Germany ..... 44 01 074.5

[51] Int. Cl.[6] ..... F02B 77/00; F02M 37/04

[52] U.S. Cl. ..... 123/198 DB; 123/510; 417/206

[58] Field of Search ..... 123/198 DB, 198 D, 123/450, 510; 417/494, 206, 349, 440

[56] References Cited

U.S. PATENT DOCUMENTS

| | | | |
|---|---|---|---|
| 1,339,798 | 5/1920 | Thompson | 123/198 DB |
| 2,642,804 | 6/1953 | Bowers | 417/206 |
| 2,937,628 | 5/1960 | Mayr | 123/198 DB |
| 3,159,036 | 12/1964 | Miller | 123/198 DB |
| 3,215,079 | 11/1965 | Roosa | 417/206 |
| 3,606,872 | 9/1971 | Eckert | 123/198 DB |
| 3,865,518 | 2/1975 | Sjotun | 417/440 |
| 3,910,724 | 10/1975 | Okamoto | 417/206 |
| 4,118,156 | 10/1978 | Ivosevic | 417/494 |
| 4,325,676 | 4/1982 | Fenne et al. | 417/206 |
| 4,555,221 | 11/1985 | DuBois | 417/349 |
| 4,662,825 | 5/1987 | Djordjevic | 417/206 |
| 4,792,285 | 12/1988 | Chapman | 417/206 |
| 4,915,592 | 4/1990 | Mishinuma et al. | 417/206 |
| 4,925,196 | 5/1990 | Green | 123/198 DB |
| 4,995,355 | 2/1991 | Cowley | 123/198 DB |
| 5,365,906 | 11/1994 | Deweedt | 123/510 |

FOREIGN PATENT DOCUMENTS

| | | |
|---|---|---|
| 0299337A2 | 1/1989 | European Pat. Off. . |
| 1914741 | 5/1972 | Germany . |
| 2243398 | 9/1972 | Germany . |
| 2505400A1 | 8/1976 | Germany . |
| 2924768A1 | 1/1981 | Germany . |
| 3542938A1 | 6/1987 | Germany . |
| 4024242A1 | 2/1991 | Germany . |
| 4126640A1 | 3/1993 | Germany . |
| 4134184A1 | 4/1993 | Germany . |
| 4213781A1 | 10/1993 | Germany . |

*Primary Examiner*—Carl S. Miller
*Attorney, Agent, or Firm*—Ladas & Parry

[57] ABSTRACT

A device presenting a high-pressure pump, and a low-pressure pump connected upstream from the first. To prevent damage in the event of a fault on the device, the connection between the low- and high-pressure pumps is provided with a cutoff valve which is closed in the event of a fault on the low-pressure pump to prevent the intake of solid particles by the high-pressure pump. Also, in the event of a fault on one of the injectors, detected on the basis of the operating conditions of the engine, the low-pressure pump is disconnected to prevent seriously damaging the engine.

18 Claims, 2 Drawing Sheets

PUMP DEVICE FOR SUPPLYING FUEL FROM A TANK TO AN INTERNAL COMBUSTION ENGINE

BACKGROUND OF THE INVENTION

The present invention relates to a pump device for supplying fuel from a tank to an internal combustion engine, and comprising a high-pressure pump and a low-pressure pump, the second connected upstream from the first.

A pump device of the aforementioned type is described, for example, in DE 41 26 640 A1, and forms part of an injection system which, in addition to the high- and low-pressure pumps, also comprises numerous electromagnetic injectors and other hydraulic components. The low-pressure pump is normally a rotary-vane or -roller pump which is operated by a small electric motor and housed directly inside the tank. Despite the high technical standard of modern internal combustion engine injection system components, defects involving, for example, the low-pressure pump or injectors cannot be altogether avoided and result in irregular fuel supply and, in extreme cases, in irreparable damage to the engine.

SUMMARY OF THE INVENTION

It is an object of the present invention to provide a device featuring a high-pressure pump and a low-pressure pump, and which, in the event of a fault in the injection system, and more specifically on the low-pressure pump or one of the injectors, provides for safely preventing damage to the injection system or the engine.

According to the present invention, there is provided a pump device for supplying fuel from a tank to an internal combustion engine, and comprising a high-pressure pump, and a low-pressure pump connected upstream from the high-pressure pump; characterized in that, for cutting off connection between said low-pressure pump and said high-pressure pump, said connection is provided with cutoff means.

BRIEF DESCRIPTION OF THE DRAWINGS

Two preferred embodiments of the present invention will be described by way of example with reference to the accompanying drawings, in which.

DETAILED DESCRIPTION OF THE INVENTION

Figure 1:
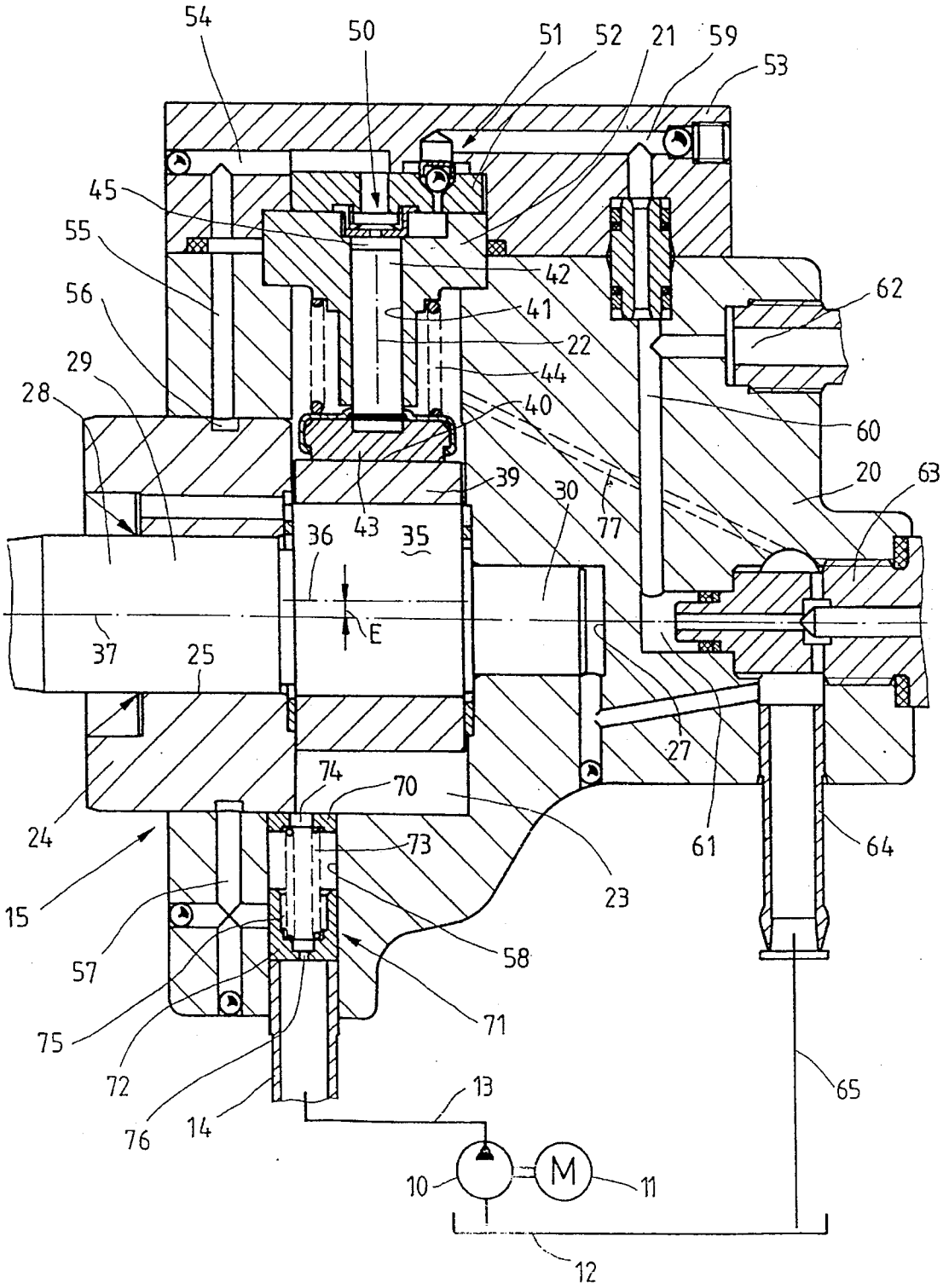
FIG. 1 shows a half section of a high-pressure pump forming part of a fuel supply pump device in accordance with the present invention.

Number 10 in FIG. 1 indicates a low-pressure fuel supply pump which may comprise a rotary-vane or roller pump operated by a small electric motor 11, and which, together with motor 11, is housed inside the fuel tank 12 of a vehicle featuring an internal combustion engine, in particular a diesel engine.

Pump 10 draws the fuel from tank 12 and feeds it along a conduit 13 and a fitting 14 to a high-pressure pump 15 consisting of a radial-piston pump located directly on and operated by the diesel engine. Pump 15 presents three cylinders 21 housed radially inside a casing 20 with their axes 22 equally spaced angularly 120° apart; and, at the center of casing 20, there is provided a cup-shaped inner chamber 23 closed by a flange 24.

The drive shaft 28 of pump 15 is connected to the diesel engine (not shown) and fitted inside a hole 25 in flange 24 and inside a dead hole 27 in casing 20 by means of two spaced bearing portions 29 and 30 between which shaft 28 presents an eccentric portion 35—hereinafter referred to as a "cam"—housed in chamber 23 and consisting of a cylinder 35, the axis 36 of which is offset by distance E in relation to the axis 37 of shaft 28.

Cam 35 is fitted in rotary manner with a control ring 39 presenting three external flat portions 40, all located the same distance from axis 36 of cam 35 and equally spaced angularly about the outer surface of ring 39. Portions 40 are perpendicular to the corresponding axes 22 of cylinders 21, and enclose an angle of 120°.

Each cylinder 21 presents a cylindrical chamber 41 coaxial with respective axis 22 and housing a precision-fitted piston 42 projecting inwards from cylinder 21. The projecting portion of each piston 42 is fitted with a shoe 43 which is maintained contacting respective flat portion 40 by a preloaded spring 44 fitted between shoe 43 and a shoulder on the outward portion of cylinder 21.

When shaft 28 is rotated, ring 39 maintains its position by virtue of shoe 43 being maintained contacting respective flat portion 40 by spring 44, but axis 36 of ring 39 rotates about axis 37 of shaft 28, so that flat portions 40 are also moved parallel to themselves in a circular orbit and, in conjunction with springs 44, provide for moving pistons 42 back and forth inside chambers 41.

The front end of each piston 42, opposite the end facing ring 39, defines, inside cylinder 21, a compression chamber 45, the volume of which varies with the movement of piston 42. When piston 42 is moved radially inwards, chamber 45 expands to draw in fuel; and, during the compression stroke of piston 42 following the intake stroke, the fuel is expelled under pressure from chamber 45.

To control the above two phases, each cylinder 21 presents an intake valve 50 and a compression valve 51, both operating as nonreturn valves, and the seats of which are formed in a single plate 52 fixed between the inner surface of cylinder head 53 facing cylinder 21, and the outer surface of cylinder 21 facing head 53. Head 53 therefore keeps cylinder 21 inside casing 20, and is screwed to casing 20 by means of screws outside cylinder 21.

Fuel is supplied to intake valve 50 of cylinder 21 along a channel 54 in respective cylinder head 53, and along a radial channel 55 formed in casing 20 and communicating with inner chamber 23 at flange 24. For this purpose, casing 20 presents three channels 55, in the plane of which flange 24 presents an annular groove 56 communicating with a channel 57 in casing 20. Casing 20 also presents a cylindrical seat 58 housing fitting 14 and in which channel 57 terminates, and which therefore extends radially towards inner chamber 23.

Via compression valve 51, fuel is fed along a channel 59 in respective cylinder head 53, and along a channel 60 in casing 20. One of the three channels 60 is connected to a pressure fitting 62, and all three channels 60 terminate in an axial cavity 61 coaxial with casing 20 and housing an electromagnetic pressure regulating valve 63 for maintaining a given pressure in fitting 62. The fuel from valve 63 is fed through a fitting 64 and along a drain conduit 65 back into tank 12.

At the outlet of seat 58 at inner chamber 23, there is provided an end plate 70; and, between fitting 14 and end plate 70, seat 58 houses a cutoff valve 71 and a piston 72 for controlling valve 71. Casing 20 of pump 15 therefore also forms the casing of valve 71 which provides for cutting off connection between fitting 14 and channel 57 in casing 20.

For this purpose, a helical compression spring 73 is compressed between piston 72 and end plate 70, for pushing piston 72 in the closed direction towards the front end of fitting 14 housed inside seat 58. To open valve 71, piston 72 is raised by the fuel pressure inside conduit 13 and fitting 14, i.e. in normal conditions, by the fuel supply pressure.

As helical spring 73 is weak, the fuel supply pressure is sufficient to raise piston 72 towards plate 70 in opposition to spring 73, so that, when pressurized fuel is present inside fitting 14, channel 57 is opened to communicate with seat 58, thus also opening cutoff valve 71. Conversely, if the fuel supply pressure falls below a given value, spring 73 pushes piston 72 against fitting 14, and channel 57 is closed and disconnected from conduit 13, thus closing cutoff valve 71.

As shown in FIG. 1, seat 58 and end plate 70 project towards flange 24 which therefore provides for maintaining plate 70 in fluidtight manner inside seat 58. Plate 70 and piston 72, however, present respective through axial holes 74 and 75; and hole 75 presents a choke 76 enabling fuel flow from fitting 14 into chamber 23. Even when helical spring 73 is fully pressed, fuel supply is not cut off by virtue of choke 76 and axial hole 74 being located inside the coils of spring 73.

Via a hole 77 in casing 20, inner chamber 23 communicates with the drain side of valve 63 and hence with drain conduit 65. Under normal operating conditions of low-pressure pump 10, a constant supply of fuel is maintained inside inner chamber 23, so that the pressure on the side of piston 72 facing plate 70 is lower than the fuel supply pressure, and the resultant of the action of spring 73 and the lower pressure on piston 72 is less than the force exerted on piston 72 by the fuel supply pressure. Under normal operating conditions, therefore, wherein fuel is supplied by low-pressure pump 10, cutoff valve 71 is open, and fuel is supplied to intake valves 50 of cylinders 21 via channel 57, annular groove 56 and channels 55 and 54.

During the intake stroke of pistons 42, fuel is drawn into, and therefore expands, compression chambers 45; and, during the compression stroke, the fuel is forced through compression valves 51 into channels 59 and 60, cavity 61 and pressure fitting 62. The surplus fuel not required by the engine is fed back into tank 12 via pressure regulating valve 63.

As the delivery of low-pressure pump 10 is greater than the maximum delivery of high-pressure pump 15, surplus fuel flows at all times through choke 76 in hole 75 of piston 72 into inner chamber 23, and from chamber 23 along hole 77 and conduit 65 into tank 12, thus cooling high-pressure pump 15.

In the event of a fault on low-pressure pump 10, the fuel supply pressure falls, so that cutoff valve 71 is closed; channel 57 is disconnected from both low-pressure pump 10 and inner chamber 23; and intake by high-pressure pump 15 is therefore limited to the fuel remaining in the intake portion between cutoff valve 71 and intake valves 50, thus minimizing the risk of solid particles from the damaged low-pressure pump 10 or from inner chamber 23 reaching and possibly damaging cylinders 21, pressure regulating valve 63 or the injectors.

In the event of a fault on one of the injectors, e.g. an injector jammed in the open position, motor 11 of low-pressure pump 10 is turned off, so that the pressure in fitting 14 falls, cutoff valve 71 is closed, and, shortly after, fuel supply to the engine is cut off to prevent further damage.

With reference to the embodiment in FIG. 2, this again shows casing 20 of pump 15; flange 24; cylinder head 53 connected to casing 20; one of the three cylinders 21; plate 52 between cylinder 21 and cylinder head 53, for supporting intake valve 50 and compression valve 51; channels 54 and 55 of the intake portion of cylinder 21; annular groove 56; and channel 59 to the pressure fitting. All the above components and channels are identical to those in the FIG. 1 embodiment.

Figure 2:
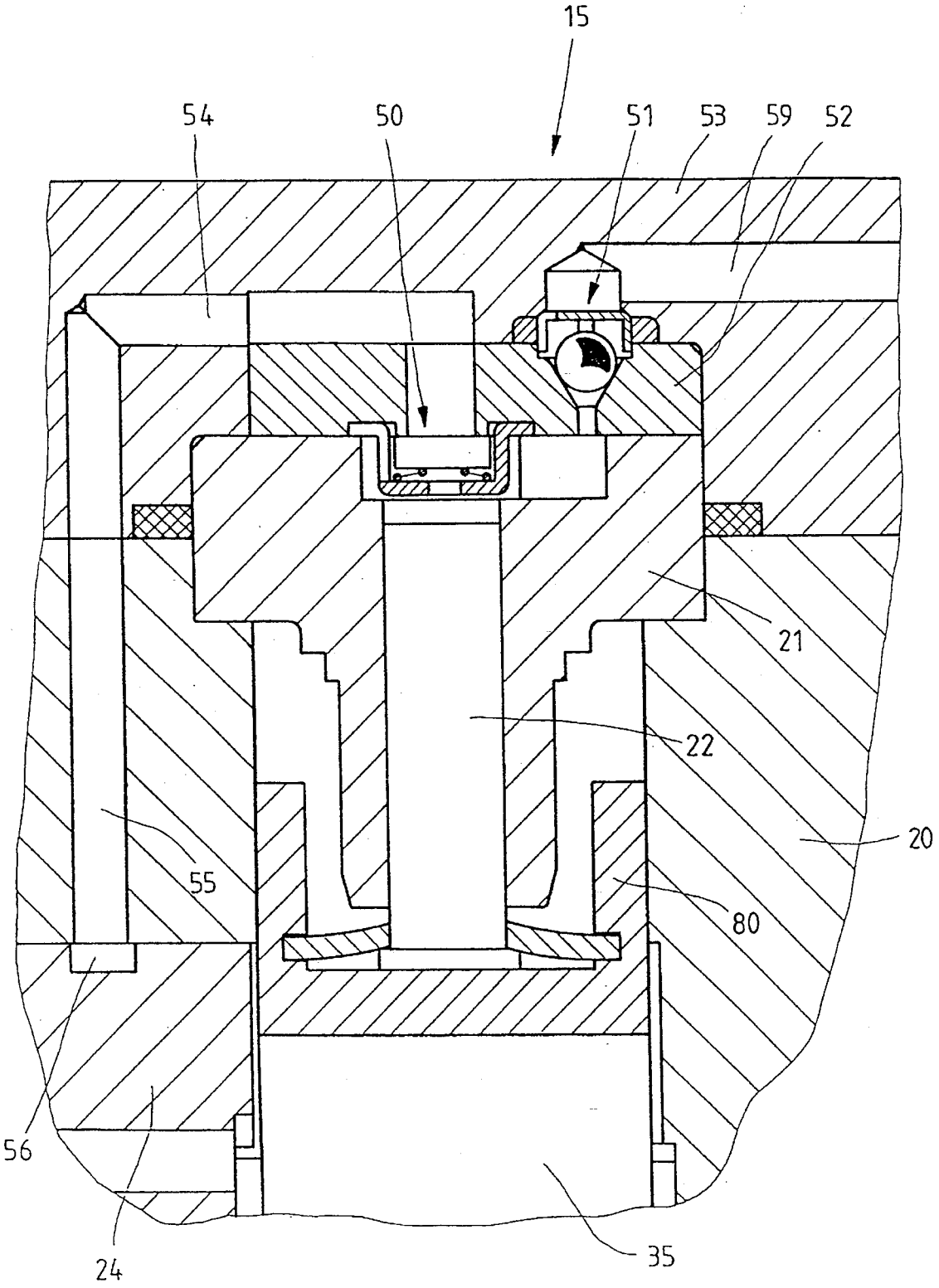
FIG. 2 shows a partial section of the high-pressure pump according to a further embodiment of the present invention.

The FIG. 2 embodiment differs from that in FIG. 1 by piston 42 being connected in fluidtight manner to a shoe 80 which is guided by casing 20 of pump 15 and, as opposed to resting on a flat portion of a ring controlling the piston and in turn rotating on a cam, cooperates with the cylindrical peripheral surface of cam 35 of shaft 28, which provides for controlling pistons 42.

Another important difference between the FIG. 1 and 2 embodiments is that no spring is provided for pushing piston 42 and shoe 80 towards cam 35. Upon a fall in Supply pressure, piston 42 remains in the top dead center position shown in FIG. 2, thus cutting off fuel supply even faster than in the FIG. 1 embodiment and even enabling cutoff valve 71 in FIG. 1 to be dispensed with.

Due to the absence of springs 44, under normal operating conditions, piston 42 of pump 15 is pushed radially inwards by the fuel supply pressure, while shoes 80 are moved outwards by cam 35; and, by virtue of shoe 80 being guided by casing 20, the transverse reaction on radial piston 42, generated by friction between shoe 80 and cam 35, is transmitted directly to casing 20.

With reference to the FIG. 1 embodiment, in the event of a fault on or disconnection of low-pressure pump 10, fuel supply to high-pressure pump 15 may be cut off immediately by simply providing a strong spring for closing intake valve 50. The force of the spring must be such that the vacuum formed by the intake stroke of piston 42 inside compression chamber 45 is not enough to open intake valve 50, which may only be opened by the normal fuel supply pressure, in the absence of which, intake valve 50 remains closed, thus cutting off fuel supply by high-pressure pump 15. In this case also, the cutoff valve may be dispensed with.

Clearly, changes may be made to the device as described and illustrated herein without, however, departing from the scope of the present invention.

We claim:

1. A pump device for supplying fuel to an internal combustion engine, said pump device comprising:

a high-pressure radial-piston pump (15) having a casing (20), a cam (35, 39) rotating in an inner chamber (23) of said casing (20), and at least one radial piston (42) operated by said cam (35, 39) for varying the volume of a compression chamber (45), said piston (42) being arrested inwards against said cam (35, 39); and a low-pressure pump (10) upstream from said high-pressure pump (15) and comprising a connection (13, 14, 54–57) between said low-pressure pump (10) and said compression chamber (45), and a cutoff valve (71) provided in said connection (13, 14, 54–57) between said low-pressure pump (10) and said compression chamber (45), and a cutoff valve (71) provided in said connection (13, 14, 54–57) and including a movable member (72) operated in one direction by a spring element (73) for cutting off communication with said compression chamber (45) and directing surplus fuel supplied by said low-pressure pump (10) towards said inner chamber (23).

2. A pump device for supplying fuel to an internal combustion engine, said pump device comprising:

a high-pressure piston pump (15) having a casing (20), a control element (35, 39) housed in an inner chamber (23) of said casing (20), and at least one piston (42) operated by said element (35, 39) for varying the volume of a compression chamber (45); and a low-pressure pump (10) upstream from said high-pressure pump (15) and comprising connection (13, 14, 54–57) between said low-pressure pump (10) and said compression chamber (45), and a cutoff valve (71) provided in said connection (13, 14, 54–57) and including a movable member (72) operated in one direction by a spring element (73) for cutting off communication with said compression chamber (45) and directing surplus fuel supplied by said low-pressure pump (10) towards said inner chamber (23).

3. A pump device as claimed in claim 1, characterized in that the casing (20) of said high-pressure pump (15) also forms the casing of said valve (71).

4. A pump device as claimed in claim 3, wherein said member (72) is movable axially inside a seat (58) of said casing 20 and is operated in an open direction by fuel supply pressure in opposition to said spring element (73).

5. A pump device as claimed in claim 4, characterized in that fuel supply from said low-pressure pump (10) and through said valve (71) is effected axially inside said seat (58) and towards said member (72); an intake channel (57) for said high-pressure pump (15) extending from a wall of said seat (58).

6. A pump device as claimed in claim 5, characterized in that said seat (58) houses a fitting (14), one end of which forms a stop for said member (72) in the direction in which said valve (71) is closed.

7. A pump device as claimed in claim 1, characterized in that, upstream from said valve (71), said inner chamber (23) communicates with a conduit (13, 14, 57) located between said low-pressure pump (10) and said high-pressure pump (15); said conduit (13, 14, 57) being disconnectable from said compression chamber (45) by said valve (71).

8. A pump device as claimed in claim 1, characterized in that means (76) are provided for reducing the pressure in said inner chamber (23) in relation to the supply pressure; and said member (72) is operated in the closing direction by the pressure inside said inner chamber (23).

9. A pump device as claimed in claim 8, characterized in that said pressure reducing means comprise a choke (76).

10. A pump device as claimed in claim 7, characterized in that said inner chamber (23) is connected to said conduit (13, 14, 57) by said member (72).

11. A pump device as claimed in claim 10, characterized in that said pressure reducing means (76) are located on said member (72).

12. A pump device as claimed in claim 10, wherein said member (72) is movable on a seat (58) of said casing (20) terminating in said inner chamber (23); said seat (58) houses an end plate (70) presenting at least one opening (74); and said spring element (73) is between said end plate (70) and said member (72).

13. A pump device as claimed in claim 12, characterized in that said spring element is in the form of a helical spring (73); and said opening (74) and a through hole (75) in said member (72) are located inside the coils of said helical spring (73).

14. A pump device as claimed in claim 12, characterized in that said inner chamber is substantially cup-shaped and closed by a flange (24); said seat (58) terminating at a wall of said inner chamber (23) and being covered partly by said flange (24); and said end plate (70) being housed in fluidtight manner in said seat (58).

15. A pump device as claimed in claim 2, wherein, when said low-pressure pump (10) is disconnected in the event of abnormal fuel supply, said spring element (73) causes said member (72) to return in said one direction.

16. A pump device as claimed in claim 2, characterized in that at least one piston (42) of said high-pressure pump (15) is pushed solely by the fuel supply pressure against a stroke control element (35).

17. A pump device as claimed in claim 16, characterized in that said piston (42) is pushed against said stroke control element (35) via the interposition of a shoe (80) guided by said casing (20).

18. A pump device as claimed in claim 15, characterized in that the intake valve (50) of said piston (42) is a nonreturn type, and comprises a spring which is so preloaded as to keep said intake valve (50) closed in the event of a vacuum inside said compression chamber (45).

* * * * *